United States Patent [19]

Pozzobon

[11] Patent Number: 4,715,132

[45] Date of Patent: Dec. 29, 1987

[54] SKI BOOT FOR DISAPPEARING-TYPE BINDINGS

[75] Inventor: Alessandro Pozzobon, Paderno di Ponzano Veneto, Italy

[73] Assignee: Nordica S.p.A., Montebelluna, Italy

[21] Appl. No.: 897,562

[22] Filed: Aug. 18, 1986

[30] Foreign Application Priority Data

Sep. 4, 1985 [IT] Italy ..... 22066 A/85

[51] Int. Cl.[4] ..... A43B 5/04; A63C 9/086

[52] U.S. Cl. ..... 36/117; 280/613

[58] Field of Search ..... 36/117–121; 280/613, 611

[56] References Cited

U.S. PATENT DOCUMENTS

| | | | |
|---|---|---|---|
| 3,772,802 | 11/1973 | Smolka et al. | 36/117 |
| 3,834,723 | 9/1974 | Erlebach | 36/117 X |
| 3,869,136 | 3/1975 | Jackson | 36/117 X |
| 3,931,980 | 1/1976 | Marker | 280/613 |
| 3,947,051 | 3/1976 | Sittmann | 280/613 X |
| 4,653,203 | 3/1987 | De Matthesis | 36/117 |

FOREIGN PATENT DOCUMENTS

| | | | |
|---|---|---|---|
| 0105011 | 4/1984 | European Pat. Off. | 280/613 |

*Primary Examiner*—James Kee Chi

*Attorney, Agent, or Firm*—Guido Modiano; Albert Josif

[57] ABSTRACT

This ski boot for disappearing-type bindings, on the sole of the boot, in a recess for accommodating the binding, comprises at least one small block defining an engagement seat for one of the pushers of the binding. The small block is movable between an engagement position, in which it engages the pusher and a retracted position, allowing unfastening of the binding. A locking mechanism is provided for holding the small block in the engagement position and may be operated from the outside of the ski boot for allowing movement of the small block in the retracted position.

4 Claims, 6 Drawing Figures

SKI BOOT FOR DISAPPEARING-TYPE BINDINGS

BACKGROUND OF THE INVENTION

The present invention relates to a ski boot for disappearing-type bindings.

As is known, ski bindings are currently available on the market which are arranged in a central position under the sole of the boot and are seated in a recess defined in the sole itself. These binds generally comprise a front ferrule or pusher and with a rear pusher, which engage with seats provided in the recess.

Currently, in order to perform the intentional unfastening of the boot from the ski, mechanical parts are provided that, generally, employ the lever effect between the ski and the boot to expel the boot from the binding.

Other known embodiments act by inhibiting the action of the springs which bias the pushers and adjust the pushers themselves.

In the known embodiments, therefore, a relatively large effort must be necessarily exerted in order to obtain the unfastening, or possibly it is necessary to provide protruding parts which allow to perform the unfastening.

SUMMARY OF THE INVENTION

The aim of the invention is to eliminate the previously described disadvantages by providing a ski boot which itself provides the part intended for unfastening the boot, thus eliminating any protruding parts and additional elements, necessary according to the known art.

Within the scope of the above described aim, a particular object of the invention is to provide a ski boot which becomes an active part of the fastening function to the ski, already housing a part of the mechanism and factually contributing towards a better integration among the ski, the binding and the boot.

Still another object of the present invention is to provide a ski boot in which the unfastening may be performed with extreme speed and simplicity, and wherein the unfastening elements, being directly built-in in the boot, are not subject to shocks or to accumulations of snow and the like which could cause damage thereto.

Another object of the present invention is to provide a ski boot for central disappearing binding with a built-in quick-release device which, due to its peculiar constructive features, gives the greatest guarantees of reliability and safety in use.

The above described aim, as well as the objects referred to and others which will better appear hereinafter, are achieved by a ski boot for disappearing-type bindings, according to the invention, characterized in that it comprises on the sole of the boot, proximate to the positioning recess of the fastening, at least one small block defining the engagement seat with one of the hooking points of the fastening, there being furthermore provided means for the at least partial reentry of said small block into said sole for disengaging from said one of the points, said reentry means being operatable externally to said boot.

BRIEF DESCRIPTION OF THE DRAWINGS

Further features and advantages will better appear from the description of some preferred, but not exclusive, embodiments of a ski boot for central disappearing binding with a quick-release device, illustrated by way of non-limitative example in the accompanying drawings, where.

DESCRIPTION OF THE PREFERRED EMBODIMENTS

Figure 1:
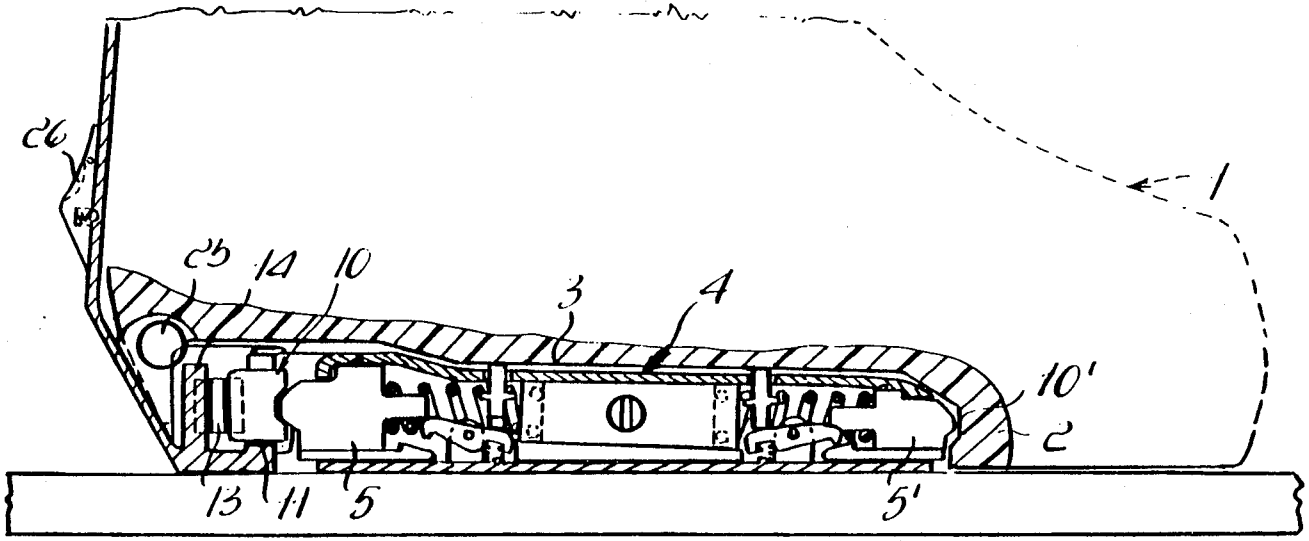
FIG. 1 is a schematic longitudinal cross-section view of a ski boot with a quick-release device.
Figure 3:
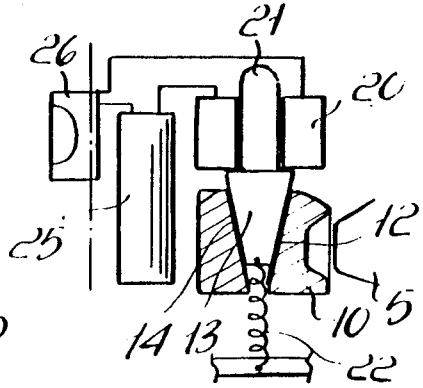
FIG. 3 shows the quick-release device in unlocking position.
Figure 2:
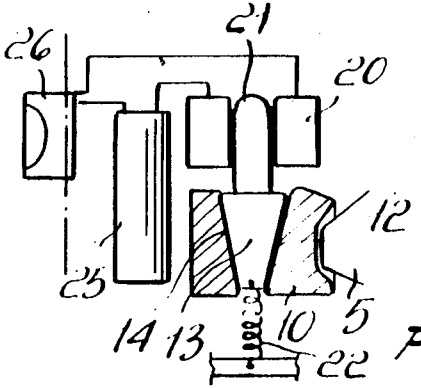
FIG. 2 is a schematic top view of the quick-release device in locking position.

With reference to FIGS. 1 to 3, the ski boot, which is generally indicated at the reference numeral 1, has a sole 2 with a tread surface which, in a per se known manner, defines a recess 3 for the positioning of the central disappearing binding, indicated generally at the reference numeral 4 and not described herein in detail, since it is the object of a co-pending application by the same applicant.

According to the invention, proximate to the above cited recess 3, at least one small block or catch member 10 is provided, which has a shaped catch reseptacle surface on one side thereof with which, as an example, is engageable the rear pusher or latch member 45 of the binding 4, while the front pusher or latch member 5' engages with a fixed abutment 10' defined at the other end of the recess 3.

Furthermore, according to the invention, the small block 10 is controlled by means which allow an at least partial reentry of the small block in the sole and thereby disengagement from the pusher 5.

In the embodiment illustrated in FIGS. 1 to 3, the small block 10 is slideably guided in a slot 11 opening at the recess and rearwardly has an abutment formation in the shape of an inclined plane 12, which engages by contact with a movable abutment member in the form of a wedge-like element 13 acting with the other side on a fixed wedge-like abutment 14.

The wedge-like element 13 is movable, preferably transversely with respect to the extension of the sole, due to the force transmitting action of an electromagnet 20 which interacts with the stem 21 connected to one base of the wedge-like element, which in turn, at the other base, is connected to a traction spring 22, acting thereon as a force transmitting means.

The electromagnet is electrically coupled by transmission means such as an electric circuit to an electric power source, comprising, as an example, a dry battery 25 located in the heel of the boot and interconnected to the electromagnet through a control action element such as an electric switch 26 position on the boot and accessible from the outside.

When the electromagnet is not activated, the wedge-like element, due to the bias of the traction spring 22, is pulled between the inclined plane of the small block 10 and the fixed wedge-like abutment 14, thus keeping the small block 10 in a position protruding from the slot 11 and engaged with the pusher 5.

In order to perform the unfastening it is sufficient to activate the electromagnet which controls the stem, causing the motion of the wedge-like element 13, with the consequent possibility of reentry of the small block 10 in its own seat and its consequent disengagement from the pusher 5.

Figure 4:
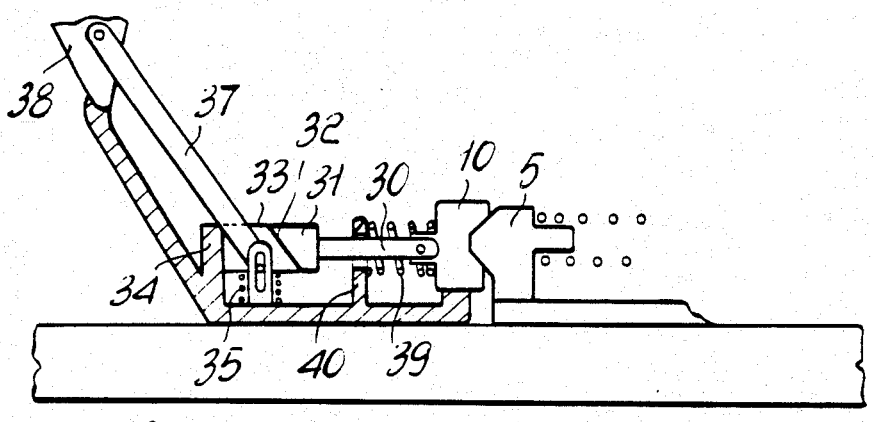
FIG. 4 is a cross-section of a detail of a different embodiment of the device.

According to a different embodiment, illustrated in FIG. 4, the small block 10 is articulated to a rod 30 ending with a body 31 having an inclined plane 32 which engages with a wedge-like small block 33, slideable along a direction perpendicular to the rod 30, against the bias of a return spring 35.

The wedge-like small block 33 is prevented from rotating by a rear abutment plane 34.

With the wedge-like small block 33 is articulated a connecting rod 37 pivotably coupled with an operating pushbutton 38 accessible from the outside of the boot and hinged to the boot at a point (not shown in FIG. 4, but corresponding to point 53 of FIG. 5), which is located remote from the pivot point of the connecting rod 37 to the pushbutton 38.

It must be furthermore added that a return spring 39 is provided, which acts between a fixed abutment projection 40 and the internal face of the small block 10 in order to keep the latter in an extracted position.

By exerting a pressing action on the pushbutton 38, the small connecting rod 37 causes the translation of the wedge-like small block 33, overcoming the bias of the return spring 35 and consequently the body 31 with the inclined plane 32 is no longer in abutment with the block 33, so that the small block 10 can easily reenter in the sole, thus aiding in the unfastening.

Figure 5:
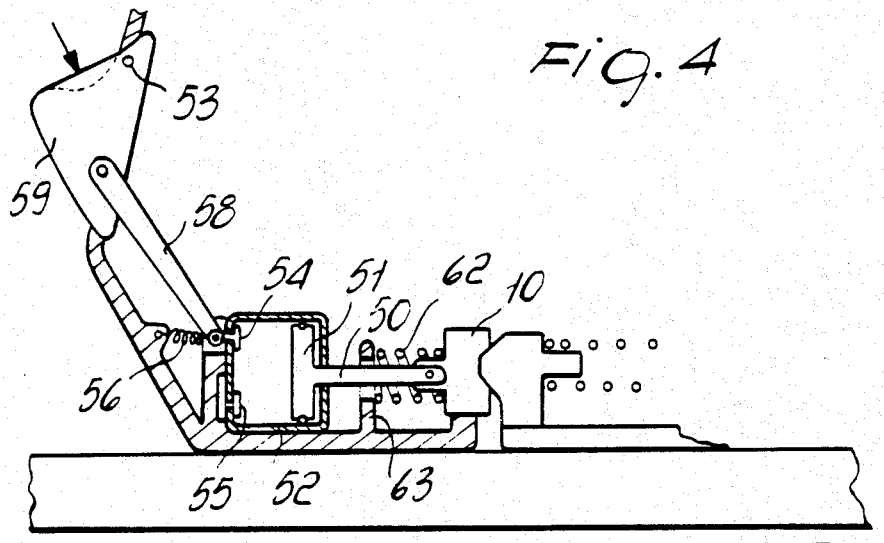
FIG. 5 is a further embodiment of the quick-release device.

According to the embodiment illustrated in FIG. 5, the small block 10 is hinged to a stem 50 of a piston 51 sealingly slideable in a cylindrical hollow body 52 which is provided, on its head, with a discharge valve 54 and with a one-way intake valve 55.

The discharge valve 54 is held in closing position by a return spring 56 and is hinged to an end of a strut 58, which is articulated, at the other end, with a pushbutton 59, accessible from the outside and pivotably coupled with the boot at 53.

By exerting a pressing action on the button 59, as indicated by the arrow, the strut 58, by overcoming the elastic bias of the return spring 56, causes the opening of the discharge valve 54 and consequently the piston 51 can slide inside the cylinder, overcoming the elastic bias of the spring 62 which acts between the small block 10 and a fixed appendix 63 defined by the boot.

The spring 62 is intended to return the piston 51 towards the outside, thus obtaining automatic opening of the one-way intake valve 55, with the consequent intake of air in the cylinder chamber, air which provides the antagonist element which prevents the reentry of the small block 10 in the sole.

Restoring of the sealing condition between the binding and the boot occurs automatically since, when the pressing action on the button 59 ceases, the return spring 56 returns the discharge valve 54 to a closed position, while the spring 62 ensures the relocation of the piston 51 in the working position by virtue of the valve 55 allowing air intake, with balance restoring.

Figure 6:
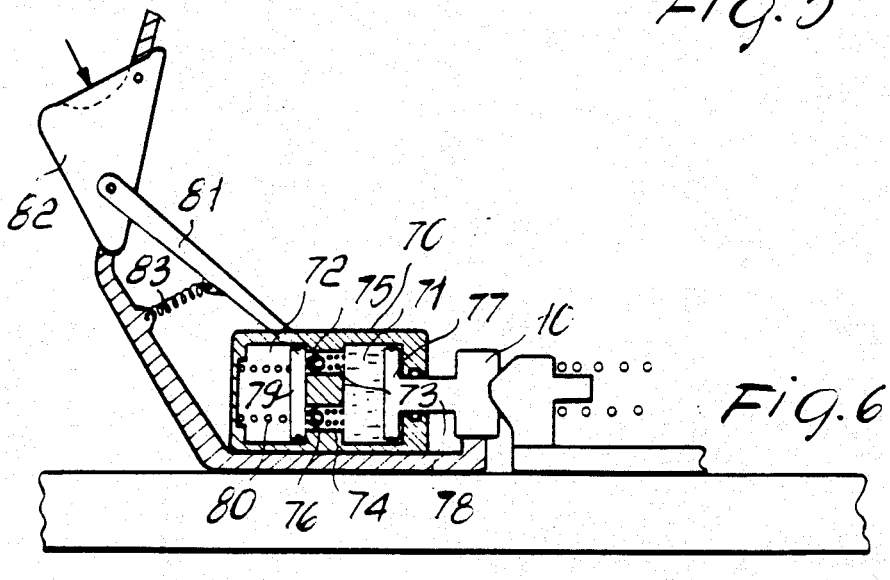
FIG. 6 is a hydraulically-operated device.

With reference to FIG. 6, an embodiment is illustrated with hydraulic operation, which comprises an external container 70, located within the sole of the boot and defining in its interior a first tank 71 and a transfer tank 72, communicating with each other by means of first and second conduits 73 and 74, respectively controlled by first and second one-way valves 75 and 76 which, in normal conditions, allow for the flow of liquid from the transfer tank 72 to the first tank 71.

In the tank 71 is sealingly slideable a small piston 77 coupled, by means of a rod 78, to the small block 10, while in the transfer tank 72 is slideably moveable a cap 79 engaged by a pusher spring 80 pushing the cap towards the ports of the conduits 73 and 74, to transfer the fluid in the tank 71.

On the first one-way valve 75 acts the end of a rod 81, articulated at the other end to a pushbutton element 82, accessible from the outside and pivotably coupled to the boot; furthermore a return spring 83 is provided, acting on the rod 81.

In practice, by exerting a pressing action on the pushbutton element 82, opening of the valve 75 is caused, thereby allowing the small piston 77 to slide and transfer of liquid from the first tank 71 in the transfer tank 72 and reentry of the small block 10, overcoming the elastic bias offered by the spring 80.

The spring 80 is intended to push the cap 79, with return of the liquid in the tank 71, by overcoming the elastic bias of the one-way valves 75 and 76 and with the exit of the small block 10 in the recess of the sole.

Restoring of the sealing condition between the binding and the boot occurs automatically, since, once the pressing action on the pushbutton element 82 ceases, the one-way valves 75 and 76 prevent the transfer of the liquid from tank 71 to tank 72 and consequently the reentry of the small block 10.

Therefore, according to the invention, with extremely simple means it is possible to actuate a shaped small block, which defines the engagement seat for one or possibly both pushers of the binding, thus aiding in unfastening, since it is sufficient to remove the action which keeps said small block in a position protruding in the recess.

Indeed, with the above described solutions, for unfastening, the possibility is allowed for the small block to reenter without particular problems within the sole, thus aiding in the unfastening between the boot and the binding.

Particularly important, furthermore, is the fact that the binding is notably simplified since the unfastening function, currently typically associated with the binding, is practically assigned to the boot.

The invention as described is susceptible of several modifications and variations, all of which are within the scope of the inventive concept.

Furthermore, all the details may be replaced by other technically equivalent elements.

I claim:

1. In a ski boot and safety ski binding assembly, comprising a binding mechanism adapted to be fixed onto the ski and including opposite outwardly projecting spring biased latch members defining a longitudinal direction of the binding and wherein the ski boot includes a sole with a tread surface having a recess adapted to encircle said binding mechanism and movable catch members supported on said ski boot within said recess and having on one side thereof a shaped catch receptacle surface for mating engagement with said latch members and an abutment formation on an opposite side thereof, an actuating mechanism within said ski boot for at least one of said movable catch members, said actuating mechanism comprising, a movable abutment member selectively in abutment relationship with said abutment formation, first force transmitting means for urging said abutment member in a position of abutment between said abutment member and said abutment formation of said catch member in which said catch member is locked in a first position in latching engagement relationship with one of said spring biased latch members, second force transmitting means for withdrawing said abutment member from said first position thereof to allow said catch member to move away from said first position thereof out of latching engagement with said spring biased latch members, a control action element arranged on said ski boot in a position accessible from the outside and transmission means for transmitting control action from said control action element to said actuating mechanism.

2. An assembly according to claim 1, wherein said abutment formation is an abutment surface and said movable abutment member is a wedge-like element movable transverse to said longitudinal direction from a first position of abutment engagement between said abutment member and said abutment surface of said catch member into a second position out of said abutment engagement.

wherein said first force transmitting means comprise spring means urging said wedge-like element into said first position thereof, wherein said second force transmitting means comprise an electromagnet in said ski boot and a stem rigid with said wedge-like element and cooperating with said electro-magnet to urge upon actuation of said electromagnet said wedge-like element into said second position thereof, wherein said transmission means comprise an electric circuit including a storage battery within said boot and wherein said control action element is a switch fixed onto said ski boot and accessible form the outside and connected with said electric circuit.

3. An assembly according to claim 1, wherein said abutment formation is a body hinged to said catch member and having an inclined plane facing away from said shaped catch reseptacle surface, wherein said movable abutment member is a wedge-like block movable transverse to said longitudinal direction from a first position of abutment engagement between said abutment member and said abutment formation of said catch member into a second position out of said abutment engagement, wherein said first force transmitting means comprise spring means urging said wedge-like block into said first position thereof, where said second force transmitting means comprise an operating push button accessible from the outside and hinged to the ski boot at an articulation point thereof, wherein said transmission means comprise a connecting rod hinged with one end thereof to said wedge-like block and with the other end thereof hinged to said push button in a point remote from said articulation point, and wherein said control action element is comprised of said push button.

4. An assembly according to claim 1, wherein said abutment formation is a coupling, wherein said movable abutment member is a piston rigid with a piston stem fixed to said catch member by means of said coupling and movable in said longitudinal direction, wherein said first force transmitting means comprise spring means urging said catch member towards said latch member and a pressure fluid cylinder with valve means in which fluid is enclosed to urge said piston towards said catch member when said valve means are closed, wherein said second force transmitting means comprise said pressure fluid cylinder in which said valve means are opened to allow exhaustion of said pressure fluid and allow said piston to move away from said catch member, wherein said transmission means comprise a connecting rod mechanism and where said control action element comprises a push button hinged to said ski boot and connected to said connecting rod mechanism.

* * * * *